US010729190B2

(12) United States Patent
McCollum et al.

(10) Patent No.: US 10,729,190 B2
(45) Date of Patent: Aug. 4, 2020

(54) HOSPITAL GOWNS AND METHOD OF MAKING THE SAME

(71) Applicant: Hampton House Medical, Inc., Raleigh, NC (US)

(72) Inventors: Carolyn H. McCollum, Raleigh, NC (US); Gail P. Spooner, Cameron, NC (US)

(73) Assignee: HAMPTON HOUSE MEDICAL, INC., Raleigh, NC (US)

( * ) Notice: Subject to any disclaimer, the term of this patent is extended or adjusted under 35 U.S.C. 154(b) by 987 days.

(21) Appl. No.: 14/080,647

(22) Filed: Nov. 14, 2013

(65) Prior Publication Data

US 2014/0173803 A1 Jun. 26, 2014

Related U.S. Application Data

(60) Provisional application No. 61/726,116, filed on Nov. 14, 2012.

(51) Int. Cl.
*A41D 13/12* (2006.01)

(52) U.S. Cl.
CPC ..... *A41D 13/1236* (2013.01); *A41D 13/129* (2013.01); *A41D 13/1245* (2013.01); *A41D 13/1272* (2013.01)

(58) Field of Classification Search
CPC ..... A41D 13/1236; A41D 13/129
See application file for complete search history.

(56) References Cited

U.S. PATENT DOCUMENTS 459,106 A * 9/1891 Fifield ..... A41D 15/00 2/114
782,819 A * 2/1905 Bifle ..... A47G 9/08 2/114
818,351 A * 4/1906 Clark ..... A41D 13/1236 2/114
1,489,046 A * 4/1924 Thompson ..... A41B 9/08 2/114
3,116,491 A * 1/1964 Previdi ..... A41D 1/20 2/102
3,574,864 A * 4/1971 Bradley ..... A41D 13/1236 2/114
4,145,763 A * 3/1979 Abrams ..... A41B 9/007 128/DIG. 15
D279,040 S * 6/1985 Horox ..... D2/720
4,570,268 A * 2/1986 Freeman ..... A41D 13/1236 2/114
4,764,986 A * 8/1988 Stewart ..... A41D 13/1245 2/115

(Continued)

*Primary Examiner* — Richale Quinn
(74) *Attorney, Agent, or Firm* — J. Bennett Mullinax, LLC

(57) ABSTRACT

Hospital gowns and methods of making hospital gowns are provided. For example, a hospital gown is provided that includes a front panel comprising an exterior surface and an opposite interior surface and a back panel comprising an exterior surface and an opposite interior surface. The front panel can be releasably securable to the back panel at different locations to create a gown with the interior surface of the front panel facing the interior surface of the back panel to form a releasable right shoulder portion, a releasable left shoulder portion, a releasable right side portion and releasable left side portion of the gown.

8 Claims, 5 Drawing Sheets

(56) References Cited

U.S. PATENT DOCUMENTS

| | | | | | |
|---|---|---|---|---|---|
| 5,611,087 | A * | 3/1997 | Adkins | A41D 13/1236 | 2/114 |
| 5,991,923 | A * | 11/1999 | Maria | A41D 13/1236 | 2/114 |
| 6,282,718 | B1 * | 9/2001 | Drakford | A41D 13/0015 | 2/115 |
| 6,499,143 | B2 * | 12/2002 | Garza | A41D 13/129 | 2/114 |

* cited by examiner

HOSPITAL GOWNS AND METHOD OF MAKING THE SAME

RELATED APPLICATIONS

This application claims priority to U.S. Provisional Patent Application Ser. No. 61/726,116, filed Nov. 14, 2012, the entire contents of which is hereby incorporated by reference herein.

TECHNICAL FIELD

The subject matter disclosed herein relates to gowns and methods of making the same. In particular, the present subject matter relates to hospital gowns that are given to and worn by patients in hospitals and other medical facilities to provide cover for the patient, while at the same time providing easy access to the patient's body to medical procedures.

BACKGROUND

A hospital gown, also known as a patient gown, exam gown, johnny shirt or Johnny gown, is a short-sleeved, thigh-length garment worn by patients in hospitals and other medical facilities. The one-size-fits-none garment remains one of the least loved aspects of American medicine. The hospital gown can be traced back as far as the 1800's where it was no more than a nightshirt with a slit up the back. Since the 1920's, only minor variations have managed to make their way to hospital rooms.

The hospital gown is made of fabric that can withstand repeated laundering in hot water, usually cotton, and is fastened at the back with twill tape ties. Disposable hospital gowns may be made of paper or thin plastic, with paper or plastic ties. Healthcare workers, especially in hospitals, find thin hospital gowns convenient for listening to the heart and lungs. For nurses, giving injections in the buttocks, abdomen, or thighs is easier when the patient is wearing a gown rather than street clothing. Hospital gowns are much thinner and looser than regular clothing, so patients are less likely to overheat.

The hospital gown has a solid front with sleeves on the side and a back that is open with two opposing unconnected edges that have a plurality of corresponding ties along the edges. The corresponding ties can be tied together to close the back and hold the gown together on the patient. With the gown only being held together by two to four fabric ties tied together in the back, the gown provides an easy-access design that works well in emergencies. The body of the patient can be easily accessed by untying the ties.

The standard hospital gown, however, is not a favorite of patients. Due to the shortness of the standard hospital gown and the open back that is often hard to keep in a closed position, most patients do not feel comfortable in the gown. It often makes the patient user feel self-conscious, especially if they have to leave their room. It is often heard and seen that patients will try to hold the back of their gowns closed with one hand as the walk down a hall in a hospital or other medical facility. The state of mind of the patient has been found an important factor in health and recovery. The distractions and self-consciousness caused by the hospital gown do not provide positive impacts on a patient's state of mind, and for some, can be detrimental to that state of mind.

The gowns used for babies and small children can be especially ineffective in providing proper cover and protection and cause different concerns from those described above. These concerns can include how best to secure the gown around a child and effectively ensuring that the gown stays on the child. Children can be especially vulnerable to ill-effects of the standard hospital gown.

Therefore, a need exists for providing patients with more comfort during their stay in a hospital or other medical facility by providing a gown that is less likely to cause distractions to and self-consciousness in the patient. At the same time, the gown should still provide the benefits of easy access to the patient's body for necessary procedures or in case of emergencies.

SUMMARY

It is an object of the present disclosure to provide novel hospital gowns and methods of making the same. For example, hospital gowns are disclosed that provides better cover for the patient, while still providing easy access to the patient's body to medical procedures.

A few objects of the presently disclosed subject matter having been stated hereinabove, and which are achieved in whole or in part by the presently disclosed subject matter, other objects will become evident as the description proceeds below when taken in connection with the accompanying documents, pictures and figures.

BRIEF DESCRIPTION OF THE DRAWINGS

A full and enabling disclosure of the present subject matter to one of ordinary skill in the art is set forth more particularly in the remainder of the specification and in the other documents, pictures and figures attached herewith, including reference to the accompanying figures in which.

DETAILED DESCRIPTION

Reference will now be made in detail to the description of the present subject matter, one or more examples of which are shown in the pictures and figures. Each example is provided to explain the subject matter and not as a limitation. In fact, features illustrated or described as part of one embodiment may be used in another embodiment to yield still a further embodiment. It is intended that the present subject matter cover such modifications and variations.

Although the terms first, second, right, left, front, back, etc. may be used herein to describe various features, elements, components, regions, layers and/or sections, these features, elements, components, regions, layers and/or sections should not be limited by these terms. These terms are only used to distinguish one feature, element, component, region, layer or section from another feature, element, component, region, layer or section. Thus, a first feature, element, component, region, layer or section discussed below could be termed a second feature, element, component, region, layer or section without departing from the teachings of the disclosure herein.

Embodiments of the subject matter of the disclosure are described herein with reference to schematic illustrations of embodiments that may be idealized. As such, variations from the shapes and/or positions of features, elements or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted or simplified to facilitate explanation of the subject matter disclosed herein. Thus, the features, elements or components illustrated in the figures are schematic in nature and their shapes and/or positions are not intended to illustrate the precise configuration of a leg protector and are not intended to limit the scope of the subject matter disclosed herein.

Figure 1:
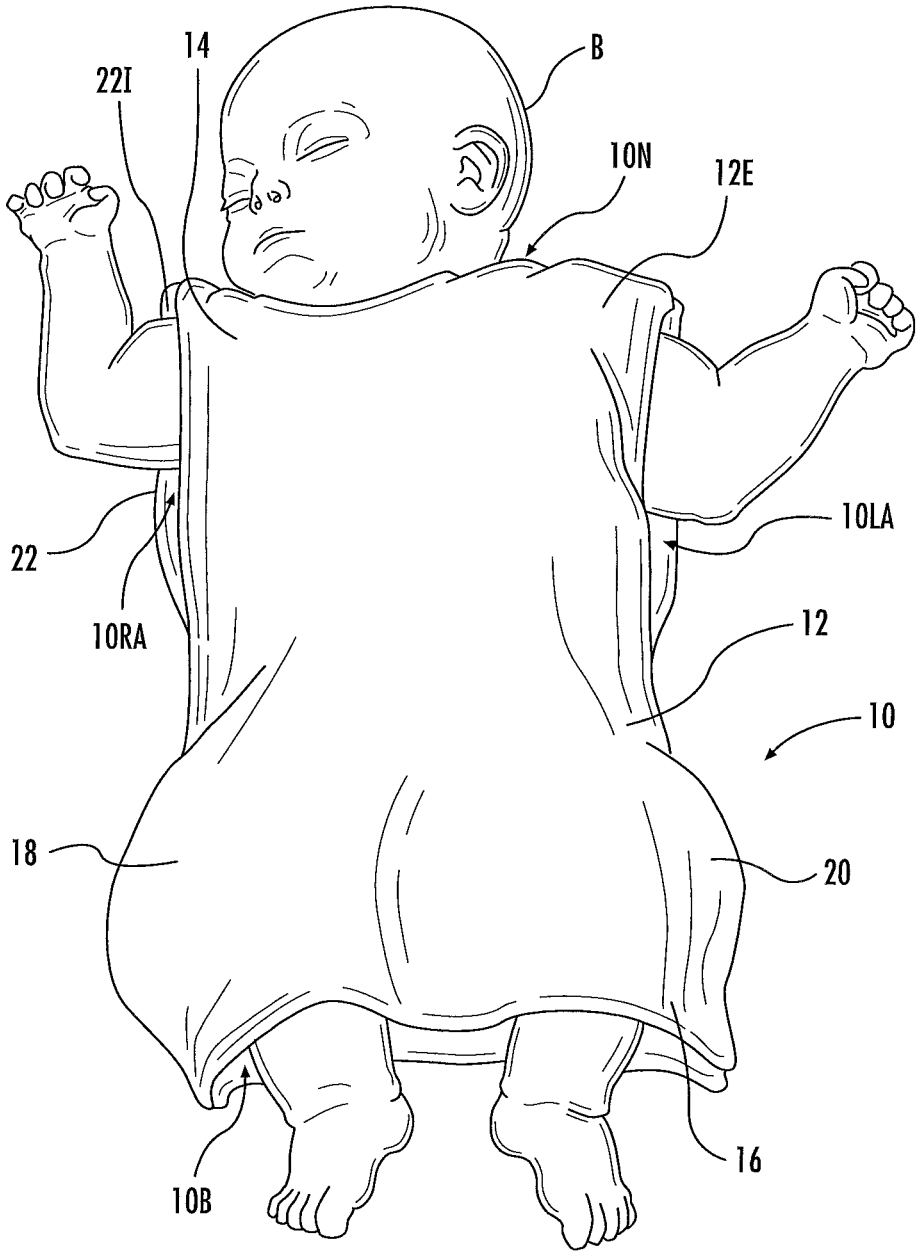
FIG. 1 illustrates a perspective view of an embodiment of a hospital gown according to the subject matter disclosed herein in use on a baby to provide coverage and protection to the body of the baby while also providing easy access to the body for medical purposes.

FIG. 1 illustrates a hospital gown, generally designated 10, that is used on a baby B to provide cover and protection to the body of the baby B, while also providing easy access to the body for medical purposes. While shown with a baby, it is understood by those skilled in the art that similarly constructed gowns 10 can be made for children, young adults, adults, and the elderly of different sizes and shapes. As shown in FIGS. 1-4, hospital gown 10 can comprises a front panel 12 comprising an exterior surface 12E and an opposite interior surface 12I and a back panel 22 comprising an exterior surface 22E and an opposite interior surface 22I. Front panel 12 can be matingly joined or secured to back panel 22 so that interior surface 12I of front panel 12 faces interior surface 22I of back panel 22 to form hospital gown 10.

Figure 2:
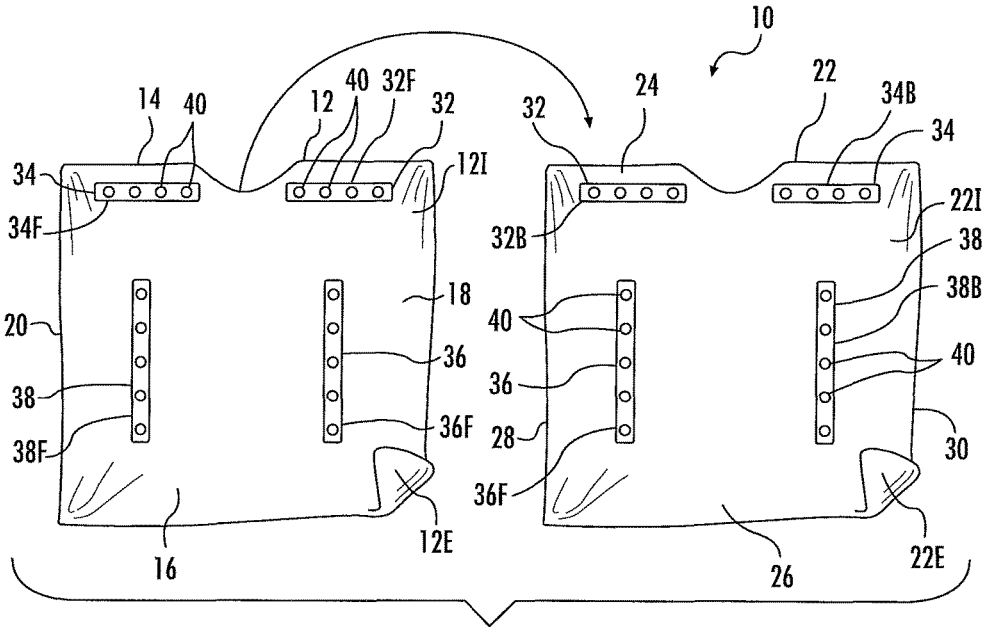
FIG. 2 illustrates a schematic top plan view of the embodiment of the hospital gown shown in FIG. 1 with two panel portions of the hospital gown laid on their exterior surfaces.

Front panel 12, with its exterior surface 12E and interior surface 12I, can each comprise a head end 14, a bottom end 16, a right side 18 and a left side 20. Similarly, back panel 22, with its exterior surface 22E and interior surface 22I, can each comprise a head end 24, a bottom end 26, a right side 28 and a left side 30. As shown in FIG. 2, front panel 12 is placed on a surface with its exterior surface 12E facing downward. The front panel 12 can comprise the front of hospital gown 10 and can have such accessories as one or more pockets emblems, or logos thereon or such features as a V-neck construction.

As shown in FIG. 2, gown 10 can comprise a right shoulder fastener device 32 that comprises a front panel right shoulder fastener member 32F attached to interior surface 12I on right side 18 of head end 14 of front panel 12 and a corresponding back panel right shoulder fastener member 32B attached to interior surface 22I on right side 28 of head end 24 of back panel 22. Front panel right shoulder fastener member 32F can be releasably secured to the corresponding back panel right shoulder fastener member 32B to form a right shoulder portion of gown 10. Gown 10 can also comprise a left shoulder fastener device 34 that comprises a front panel left shoulder fastener member 34F attached to interior surface 12I on left side 20 of head end 14 of front panel 12 and a corresponding back panel left shoulder fastener member 34B attached to interior surface 22I on left side 30 of head end 24 of back panel 22. Front panel left shoulder fastener member 34F can be releasably secured to the corresponding back panel left shoulder fastener member 34B to form a corresponding left shoulder portion of gown 10.

While shown in the Figures as the fastener members 32F, 34F, 36F, 38F of the front panel 12 and the fastener member 32B, 34B, 36B, 38B of the back panel 22 that form the releasable right shoulder, left shoulder, right side, left side portions of the gown 10 all attached to the interior surfaces of the front and back panels 12 and 22, it is to be understood that one of each corresponding fastener members 32F or 32B, 34F or 34B, 36F or 36B, 38F or 38B could be attached to the interior surface of the respective front or back panel and the other corresponding fastener members 32F or 32B, 34F or 34B, 36F or 36B, 38F or 38B could be attached to the exterior surface of the respective front or back panel.

Also shown in FIG. 2, gown 10 can comprise a right side fastener device 36 that comprises a front panel right side fastener member 36F attached to interior surface 12I on right side 18 of front panel 12 and a corresponding back panel right side fastener member 36B attached to interior surface 22I on right side 28 of back panel 22. Front panel right side fastener member 36F can be releasably secured to back panel right side fastener member 36B to form a right lower portion of gown 10 below the right shoulder portion. Gown 10 can also comprise a left side fastener device 38 that comprises a front panel left side fastener member 38F attached to interior surface 12I on left side 20 of front panel 12 and a corresponding back panel left side fastener member 38B attached to interior surface 22I on left side 30 of back panel 22. Front panel left side fastener member 38F can be releasably secured to back panel left side fastener member 38B to form a right lower portion of gown 10 below the left shoulder portion.

Figure 3:
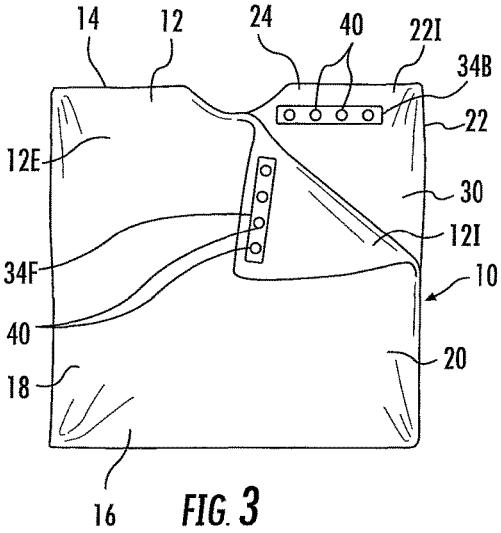
FIG. 3 illustrates a schematic top plan view of the embodiment of the hospital gown shown in FIG. 1 with the two panel portions secured together to form the hospital gown and the front panel portion folded down on a left shoulder of the gown.

Left and right shoulder fastener devices 32, 34 can be spaced apart from one another at head ends 14, 24, so that the respective fastener members 32F, 32B, 34F, 34B are secured together to form the respective right and left shoulders of gown 10 and a neck opening $\mathbf{10}_N$. When front panel 12 and back panel 14 is secured around a baby B in such a manner, neck opening $\mathbf{10}_N$ provides enough space for the neck of baby B to comfortable occupy the opening. As shown in FIG. 3, front panel left shoulder fastener member 34F and back panel left shoulder fastener member 34B of left shoulder fastener device 34 can be released (i.e., pulled apart from one another) or partially released from each other to provide access to a left upper portion of the body that occupies gown 10. Similarly, front panel right shoulder fastener member 32F and back panel right shoulder fastener member 32B of right shoulder fastener device 32 can be released or partially released from each other to provide access to a right upper portion of the body that occupies gown 10. If necessary, the shoulder fastener members 32B, 32F, 34B, 34F of both right shoulder fastener devices 32, 34 can be release from their corresponding member to provide full access to the upper body, while still providing coverage for the lower body. After the required access is completed, the respective fastener members 32B, 32F, 34B, 34F can be secured together again.

Right shoulder fastener device 32 and right side fastener device 36 can be spaced apart from one another on right sides 18, 28 of front and back panels 12, 22. In this manner, the respective fastener members 32F, 32B, 36F, 36B are secured together to form the respective right side of gown 10 and a right arm opening $\mathbf{10}_{RA}$. Similarly, left shoulder fastener device 34 and left side fastener device 34 can be spaced apart from one another on left sides 20, 30 of front and back panels 12, 22. In this manner, the respective fastener members 34F, 34B, 38F, 38B are secured together to form the respective left side of gown 10 and a left arm opening $\mathbf{10}_{LA}$. When front panel 12 and back panel 14 is secured around a baby B in such a manner, right and left arm openings $\mathbf{10}_{RA}$, $\mathbf{10}_{LA}$ provide enough space for the arms of baby B to comfortable occupy openings $\mathbf{10}_{RA}$, $\mathbf{10}_{LA}$.

By having fastener members 32B, 32F, 34B, 34F on each side above and below the arms when a patient is wearing the gown 10, a releasable right shoulder portion, a releasable left shoulder portion, a releasable right side portion and a releasable left side portion can be formed that allow easy access to most any part of the patient's body. Further, by having fastener members 32B, 32F, 34B, 34F on each side above and below the arms of a patient wearing a gown 10, the different areas of the gown can be loosened for access or for patient comfort. Additionally, changing of the gown 10 or portion of the gown 10 can also be easily accomplished. For example, in some cases, the gown 10 can be changed with minimal movement of the patient, who may be bedridden.

Figure 4:
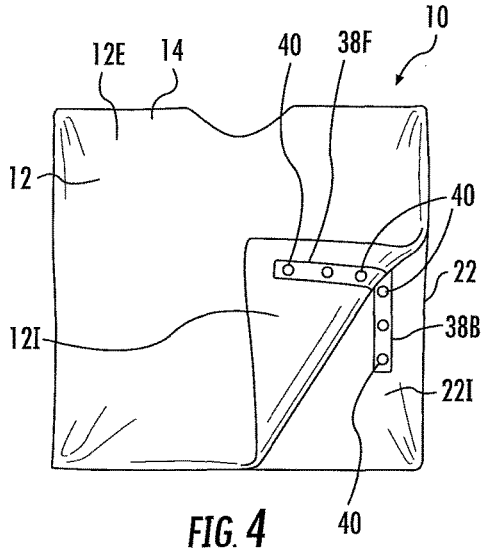
FIG. 4 illustrates a schematic top plan view of the embodiment of the hospital gown shown in FIG. 1 with the two panel portions secured together to form the hospital gown and the front panel portion folded up on a left bottom end of the gown.

As shown in FIG. 4, front panel left side fastener member 38F and back panel left side fastener member 38B of left side fastener device 38 can be released or partially released from each other to provide access to a left lower portion of the body that occupies gown 10. Similarly, front panel right side fastener member 36F and back panel right side fastener member 36B of right side fastener device 36 can be released or partially released from each other to provide access to a right lower portion of the body that occupies gown 10. If necessary, the side fastener members 36B, 36F, 38B, 38F of both right side fastener devices 36, 38 can be release from their corresponding member to provide full access to the lower body, while allowing gown 10 to still provide coverage for the upper body. After the required access is completed the respective fastener members 36B, 36F, 38B, 38F can be secured together again to provide full coverage from gown 10.

Additionally, fastener members 34B, 34F, 38B, 38F of both fastener devices 34, 38 can be released from their corresponding member to provide full access to the full left side of the body as needed, while allowing gown 10 to still provide coverage for the full right side of the body. Similarly, fastener members 32B, 32F, 36B, 36F of both fastener devices 32, 36 can be release from their corresponding fastener member to provide full access to the full right side of the body as needed, while allowing gown 10 to still provide coverage for the full left side of the body. In both instances, after the required access is completed in each case, the respective fastener members 32B, 32F, 36B, 36F, 34B, 34F, 38B, 38F can be secured together again.

The configuration of gown 10 as shown in FIGS. 1-4 provide a secure construction of gown 10 with openings for body appendages of a patient and the ability to provide access to different areas of the body of a patient wearing gown 10 without necessarily requiring the patient to move within the bed. Front and back panels 12, 22 when secured together to form gown 10 provide an opening $\mathbf{10}_{B}$ between front and back panels 12, 22 at bottom ends 16, 26 that can provide access to at least a portion of the lower body of the patient. If desired, a fastener device comprising front and back fastener members that can be disposed on the respective bottom ends 16, 26 of front and back panels 12, 22, for example, at a location that would be between the legs of the patient. While shown in rectangular shapes, front and back panels 12, 22 can be cut into different shapes to more accurately make gowns 10 that can comfortably fit different body types. Similarly, front and back panels 12, 22 can come in different sizes to make gowns 10 of different sizes.

As shown in FIGS. 1-6, each of the fastener devices can comprise one or more individual fasteners. For example, as shown in FIGS. 1-5, right shoulder fastener device 32, left shoulder fastener device 34, right side fastener device 36, and left side fastener 38 can each comprise a plurality of individual fasteners 40. For example, as shown in FIGS. 1-4, individual fasteners 40 can comprise snap fasteners that have a male connector portion and a female connector portion. By using a plurality of snap fasteners 40 on each fastener device, the amount that the fastener device is opened can be better regulated to provide an opening size that meets the needs of the medical staff, while providing better opportunity for privacy of the patient.

Similar to FIGS. 1-4, FIG. 5 illustrates a gown, generally designated 50, that can comprise a front panel 12 and a back panel 22 with fastener devices 32, 34, 36, 38 with fastener members secured on interior surfaces 12I, 22I of front and back panels 12, 22. Each fastener device 32, 34, 36, 38 comprises a plurality of individual fasteners 42. In particular, individual fasteners 42 can comprise mating hook and loop fasteners. As with the snaps fasteners 40 above, by using a plurality of hook and loop fasteners 42 on each fastener device, the amount that the fastener device is opened can be better regulated to provide an opening size that meets the needs of the medical staff, while providing better opportunity for privacy of the patient.

Figure 5:
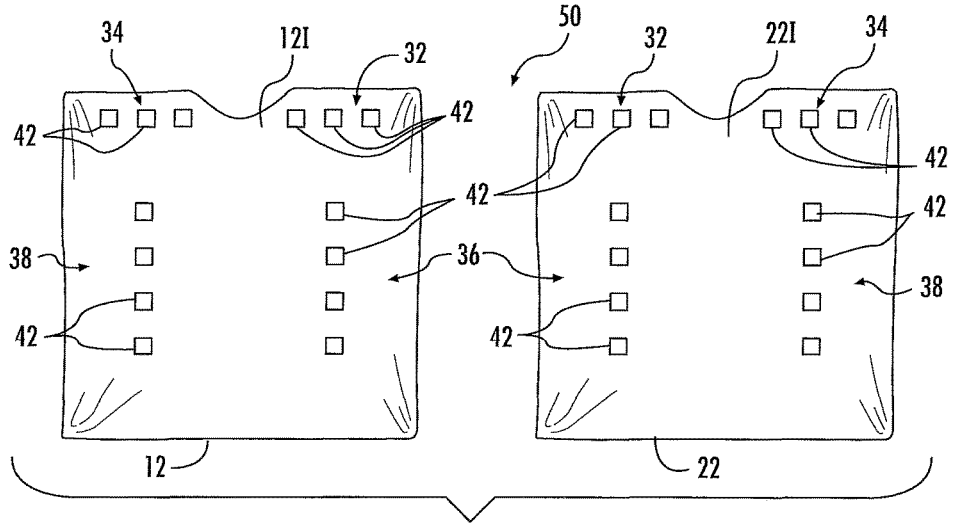
FIG. 5 illustrates a top plan view of another embodiment of a hospital gown according to the subject matter disclosed herein with two panel portions of the hospital gown laid on their exterior surfaces.
Figure 6:
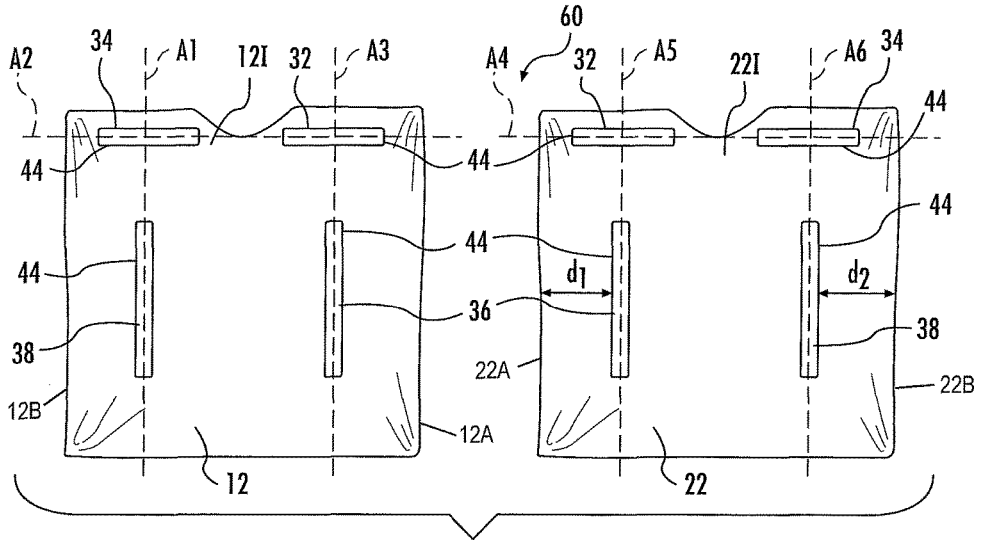
FIG. 6 illustrates a top plan view of another embodiment of a hospital gown according to the subject matter disclosed herein with two panel portions of the hospital gown laid on their exterior surfaces.

Instead of a plurality of individual hook and loop fasteners 40 as shown in FIG. 5, the fastener devices can each comprise a single hook and loop fastener as shown in FIG. 6. In particular, as shown in FIG. 6, a gown, generally designated 60, can comprise a front panel 12 and a back panel 22 with fastener devices 32, 34, 36, 38 with fastener members secured on interior surfaces 12I, 22I of front and back panels 12, 22. However, right shoulder fastener device 32, left shoulder fastener device 34, right side fastener device 36, and left side fastener each comprises a hook and loop fasteners.

Further, as shown in FIG. 6, the fastener device 36 with fastener members, or fastener device portions, secured on interior surfaces 12I, 22I of front and back panels 12, 22 that form the releasable right side portion can be positioned interior of a respective edge 12A, 22A and the fastener device 38 with fastener members, or fastener device portions, secured on interior surfaces 12I, 22I of front and back panels 12, 22 that form the releasable right side portion can be positioned interior of a respective edge 12B, 22B. For example, as shown in FIG. 6, fastener device 36 can be positioned a distance $d_1$ from a respective edge such as edge 22A and fastener device 38 can be positioned a distance $d_2$ from a respective edge such as edge 22B. In this manner, a free section of cloth can extend around the edges 12A, 12B, 22A, 22B of the respective panels 12, 22 that can be easily gripped by the patient or a hospital attendant to release the fastener devices as needed.

Also with this construction, arm openings can be easily formed by a few amount or number of fastener devices in some embodiments. For example, portions, or members, of the fastener devices 32, 34 can be connected along an axis $A_2$ on the interior surface 12I of front panel 12. Similarly, portions, or members, of the fastener devices 32, 34 can be connected along an axis $A_4$ on the interior surface 22I of back panel 22. Similarly, as shown in FIG. 6, the portion, or member, of fastener device 38 on the front panel 12 and the portion, or member, of fastener device 38 on the back panel 22 can positioned along a respective axis $A_1$, $A_6$ that intersects the releasable left shoulder portion formed by the respective portions, or members, of fastener device 34 to form a left arm opening in the gown 60. Similarly, the portion, or member, of fastener device 36 on the front panel 12 and the portion, or member, of fastener device 36 on the back panel 22 can positioned along a respective axis $A_3$, $A_5$ that intersects the releasable right shoulder portion formed by the respective portions, or members, of fastener device 32 to form a right arm opening in the gown 60. Thus, in such embodiments, the axes $A_1$, $A_6$ also intersect axis $A_2$ and the axes $A_3$, $A_5$ also intersect axis $A_4$.

In some embodiments, the portion, or member, of fastener device 38 on the front panel 12 and the portion, or member, of fastener device 38 on the back panel 22 can positioned along a respective axis $A_1$, $A_6$ that bisects the releasable left shoulder portion formed by the respective portions of fastener device 34 to form a left arm opening in the gown 60. Similarly, the portion, or member, of fastener device 38 on the front panel 12 and the portion of fastener device 38 on the back panel 22 can positioned along a respective axis $A_1$, $A_6$ that bisects the releasable right shoulder portion formed by the respective portions of fastener device 32 to form a right arm opening in the gown 60.

Figure 7:
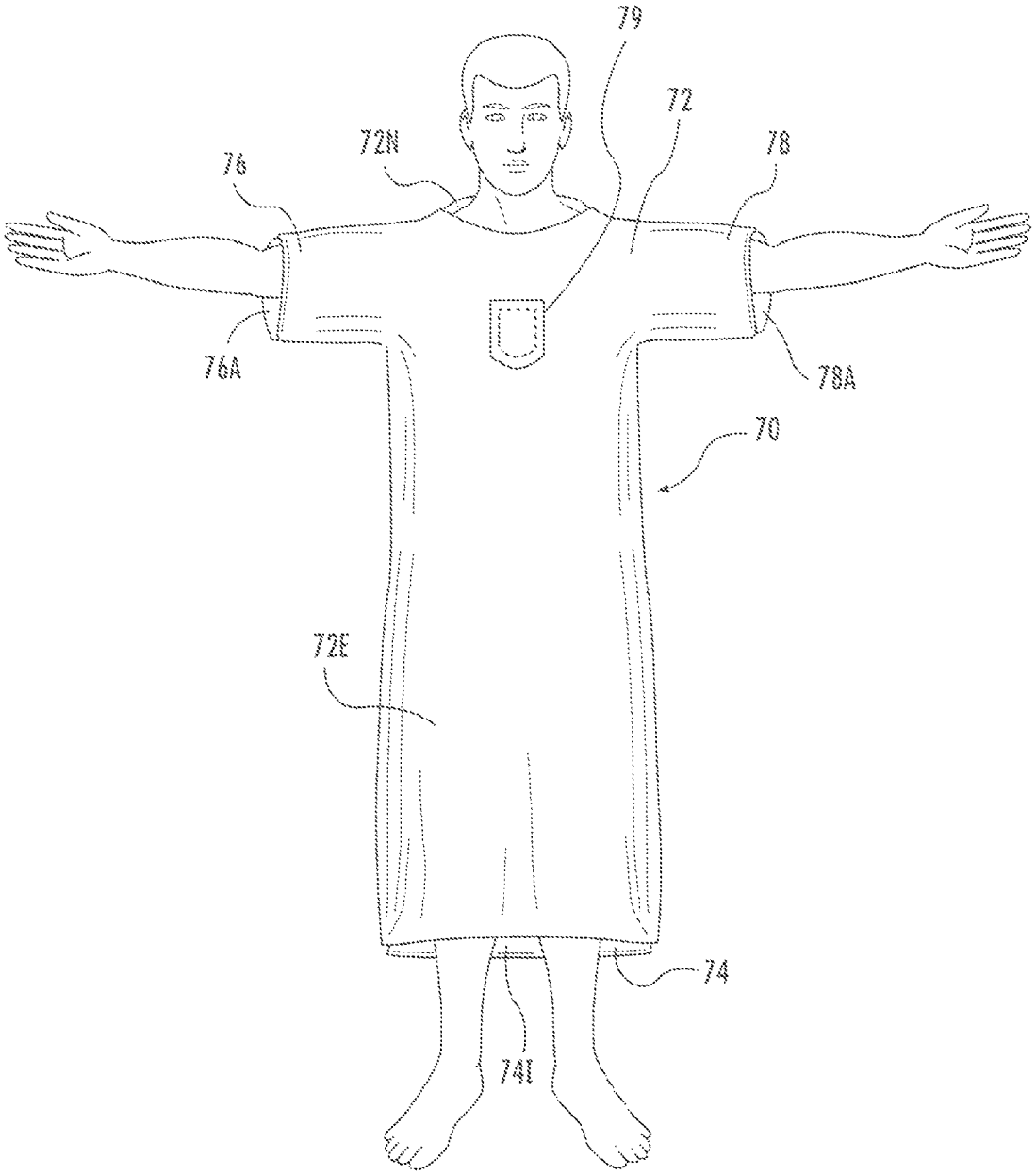
FIG. 7 illustrates a perspective view of an embodiment of a hospital gown according to the subject matter disclosed herein that can provide coverage and protection to a body of a patient while also providing easy access to the body for medical purposes.

FIGS. 7 illustrates another embodiment of a hospital gown, generally designated 70 that can provide cover and protection to the body of a patient, while also providing easy access to the body for medical purposes. Gown 70 can have a more form-fitting shape than the embodiment of gown 10 shown in FIGS. 1-4. It is understood by those skilled in the art that similarly constructed gowns 70 can be made for children, young adults, adults, and the elderly of different sizes and shapes. Further, while still having the ability to fit relatively loosely on a patient, gowns 70 can be more form-fitting and come in different sizes, such as small, medium, large, extra-large, and extra-extra-large for youths and adults.

As shown in FIG. 7, hospital gown 70 can comprises a front panel 72 comprising an exterior surface 72E and an opposite interior surface (not shown) and a back panel 74 comprising an exterior surface (not shown) and an opposite interior surface 74I. Front panel 72 can be matingly joined or secured to back panel 74 in a manner that permits detachment and reattachment so that interior surface of front panel 72 faces interior surface 74I of back panel 74 to form hospital gown 70. To allow a more form-fitting shape, front panel 72 and back panel 74 can be constructed to form sleeves 76 and 78 on either side of neck opening 72N. The exterior surface 72E of front panel 72 can comprise the front of hospital gown 70 and can have accessories thereon such as pocket 79 that can carry such items as monitoring devices. The exterior surface 72E of front panel 72 can also have emblems, or logos thereon. The front panel 72 can also have different suitable neck constructions, such as a V-neck construction.

Figure 8:
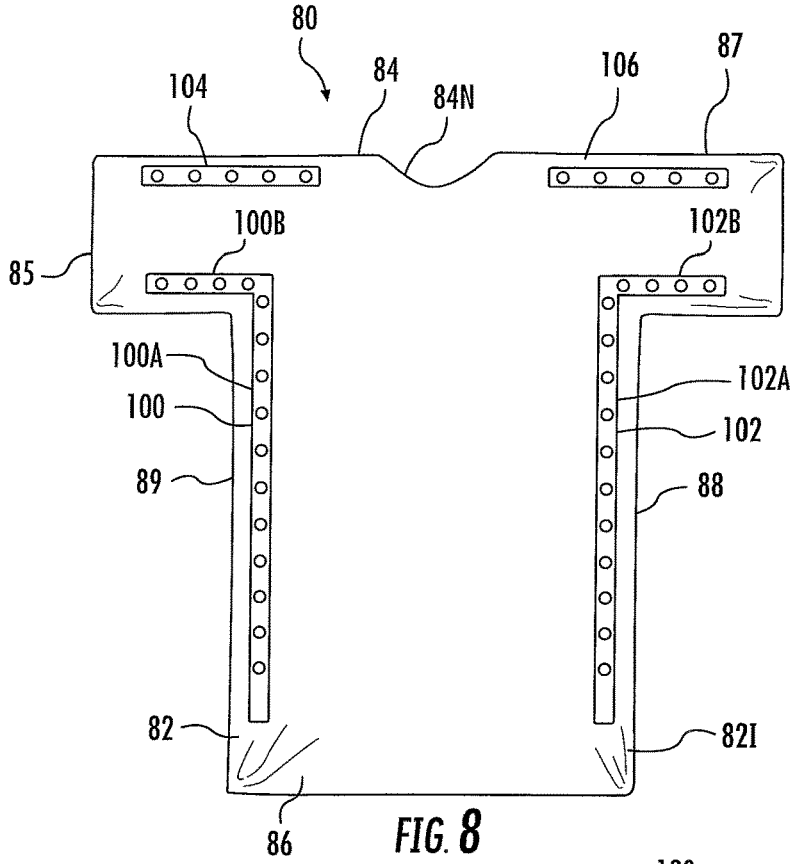
FIG. 8 illustrates a top plan view of another embodiment of a front panel portion of a hospital gown according to the subject matter laid on its exterior surfaces.
Figure 9:
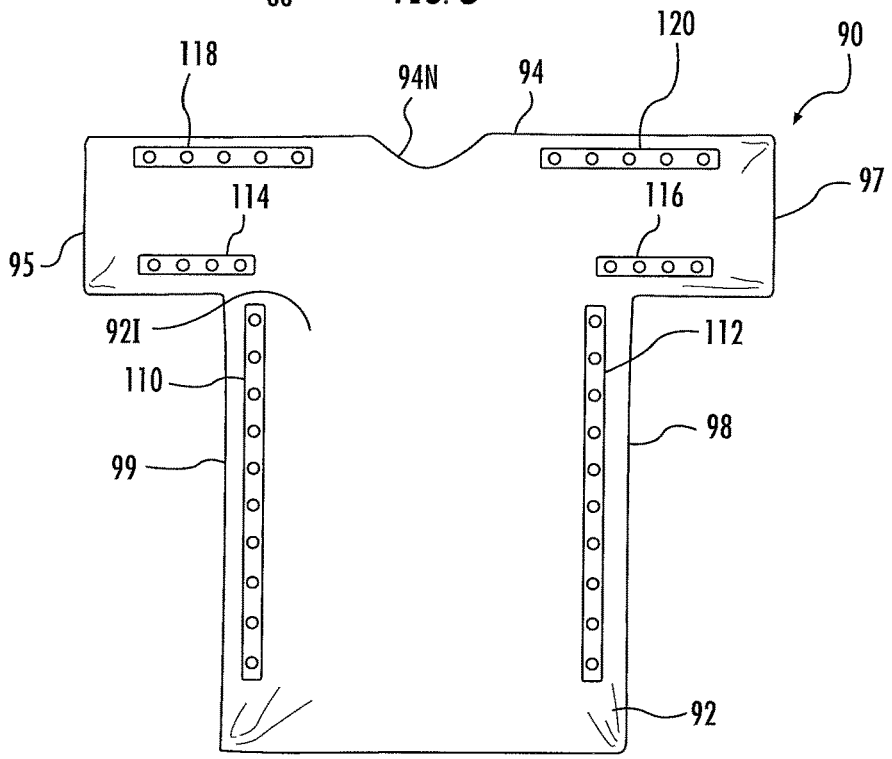
FIG. 9 illustrates a top plan view of another embodiment of a front panel portion of a hospital gown according to the subject matter laid on its exterior surfaces.

FIGS. 8 and 9 show possible embodiments of front panels that can be used in gown 70. Back panels, which are illustrated in FIGS. 2-6, are not shown in FIGS. 8 and 9, because they can generally be considered to be mirror images of the front panels shown in FIGS. 8 and 9 and description of such would be redundant.

In FIG. 8, a front panel 82 of a hospital gown 80 similar to hospital gown 70 is shown. Front panel 82 can have an exterior surface (not shown) and interior surface 82I can each comprise a head end 84 that can form a neck portion 84N, a bottom end 86, a right side 88 and a left side 89. Similarly, hospital gown 80 can have a back panel with an exterior surface and interior surface. The back panel can each comprise a head end, a bottom end, a right side and a left side since the back panel would have a similar, mirrored construction. The interior surface 82I of front panel 82 can have portions of fastener devices 100, 102, 104, and 106 that can be secured together with corresponding portions of fastener devices on a corresponding back panel (not shown). Thereby, the front panel is releasably securable to permit detachment and reattachment to the back panel at different locations by a plurality of fastener devices disposed on the interior surfaces of the front and back panels to form the releasable portions of the gown 80.

In particular, the front panel 82 can comprise left and right sleeve portions 85 and 87. A releasable left shoulder portion that can comprise a portion of left shoulder fastener device 104 can extend from the neck opening 84N along a top of the left sleeve portion 85. A releasable right shoulder portion that can comprise a portion of right shoulder fastener device 106 can extend from the neck opening 84N along a top of the right sleeve portion 87. In FIG. 8, fastener device portions 100 and 102 each aid in forming two releasable portions. A releasable left side portion that can comprise section 100A of fastener device portion 100 can be used to attach the left side of the gown 80 below the left sleeve portion 85. A releasable left bottom arm portion that can comprise section 100B of fastener device portion 100 can extend along a bottom portion of the left sleeve portion 85 below the releasable left shoulder portion formed by fastener device portion 104 and above the releasable left side portion formed by section 100A. Similarly, releasable right side portions that can comprise section 102A of fastener device portion 102 can be used to attach the right side of the gown 80 below the right sleeve portion 87. A releasable right bottom arm portion that can comprise section 102B of fastener device portion 102 can extend along a bottom portion of the right sleeve portion 87 below the releasable right shoulder portion formed by fastener device portion 106 and above the releasable right side portion formed by section 102A. Thus, as shown in FIG. 8, the sections 100A, 100B, 102A, 102B of the fastener devices that form the releasable right and left bottom arm portions and the releasable right and left side portions for each front and back panel can be integral with each other as single portions of fastener devices 100, 102.

In FIG. 9, a front panel 92 of a hospital gown 90 similar to hospital gowns 70 and 80 is shown. Front panel 92 can have an exterior surface (not shown) and interior surface 92I can each comprise a head end 94 that can form a neck portion 94N, a bottom end 96, a right side 98 and a left side 99. Similarly, hospital gown 90 can have a back panel with an exterior surface and interior surface. The back panel can each comprise a head end, a bottom end, a right side and a left side since the back panel would have a similar, mirrored construction. The interior surface 92I of front panel 92, is different from the interior surface 82I of front panel 82 of gown 80 in that separate portions of fastener devices 110, 112, 114, 116, 118 and 120 that can be secured together with corresponding portions of fastener devices on a corresponding back panel (not shown). Thereby, the front panel can be releasably securable to permit detachment and reattachment to the back panel at different locations by a plurality of fastener devices disposed on the interior surfaces of the front and back panels to form the releasable portions of the gown 90.

In particular, the front panel 92 can comprise left and right sleeve portions 95 and 97. A releasable left shoulder portion that can comprise a portion of left shoulder fastener device 118 can extend from the neck opening 94N along a top of the left sleeve portion 95. A releasable right shoulder portion that can comprise a portion of right shoulder fastener device 120 can extend from the neck opening 94N along a top of the right sleeve portion 97. In FIG. 9, a releasable left side portions that can comprise fastener device portion 110 can be used to attach the left side of the gown 90 below the left sleeve portion 95. A releasable left bottom arm portion that can comprise fastener device portion 114 can extend along a bottom portion of the left sleeve portion 95 below the releasable left shoulder portion formed by fastener device portion 118 and above the releasable left side portion formed by fastener device portion 110. Similarly, releasable right side portions that can comprise fastener device portion 112 can be used to attach the right side of the gown 90 below the right sleeve portion 97. A releasable right bottom arm portion that can comprise fastener device portion 116 can extend along a bottom portion of the right sleeve portion 97 below the releasable right shoulder portion formed by fastener device portion 120 and above the releasable right side portion formed by fastener device portion 112. Thus as shown in FIG. 8, the fastener device portions 110, 112, 114, and 116 that form the releasable right and left bottom arm portions and the releasable right and left side portions for each front and back panel can be separate from each other.

Thus, as described herein, embodiments of hospital gowns are provided. For example, in one embodiment, a hospital gown can comprise a front panel comprising an exterior surface and an opposite interior surface and a back panel comprising an exterior surface and an opposite interior surface. The front panel can be releasably securable to the back panel at different locations to create a gown with the interior surface of the front panel facing the interior surface of the back panel and to form a releasable right shoulder portion, a releasable left shoulder portion, a releasable right side portion and a releasable left side portion of the gown.

In such embodiments of the gown, a neck opening can be formed between the releasable right shoulder portion and the releasable left shoulder portion. Similarly, a right arm opening can be formed between the releasable right shoulder portion and the releasable right side portion and a left arm opening can be formed between the releasable left shoulder portion and the releasable left side portion. In some such embodiments, the front panel can be releasably securable to permit detachment and reattachment to the back panel at different locations by a plurality of fastener devices disposed on the interior surfaces of the front and back panels. In this manner, the releasable right shoulder portion, the releasable left shoulder portion, the releasable right side portion and the releasable left side portion can be formed in such embodiments.

In some embodiments, the fastener devices can each comprise a plurality of individual fasteners. In some embodiments, the individual fasteners of the plurality of individual fasteners can be snap fasteners. In some embodiments, the individual fasteners of the plurality of individual fasteners can be mating male/female fasteners. In some embodiments, the individual fasteners of the plurality of individual fasteners can be hook and loop fasteners. In some embodiments, the fastener devices each comprises a hook and loop fastener.

In some embodiments, the fastener devices that form the releasable right side portion can be positioned along an axis that intersects the releasable right shoulder portion and the fastener devices that form the releasable left side portion can be positioned along an axis that intersects the releasable left shoulder portion. For example, the fastener devices that form the releasable right side portion can be positioned along an axis that intersects an area where fastener devices that form the releasable right shoulder portion are attached and the fastener devices that form the releasable left side portion can be positioned along an axis that intersects an area where fastener devices that form the releasable left shoulder portion are attached. In some embodiments, the fastener devices that form the releasable right side portion can be positioned along an axis that bisects the releasable right shoulder portion and the fastener devices that form the releasable left side portion can be positioned along an axis that bisects the releasable left shoulder portion. For example, the fastener devices that form the releasable right side portion can be positioned along an axis that bisects an area where fastener devices that form the releasable right shoulder portion are attached and the fastener devices that form the releasable left side portion can be positioned along an axis that bisects an area where fastener devices that form the releasable left shoulder portion are attached.

In some embodiments, the hospital gown can have sleeves. For example, the front panel and the back panel can further comprise right and left sleeve portions. In such embodiments, the releasable right shoulder portion can extend from the neck opening along a top of the right sleeve portion and the releasable left shoulder portion can extend from the neck opening along a top of the left sleeve portion. Also, in such embodiments, a releasable right bottom arm portion can extend along a bottom portion of the right sleeve portion below the releasable right shoulder portion and above the releasable right side portion and a releasable left bottom arm portion can extend along a bottom portion of the left sleeve portion below the releasable left shoulder portion and above the releasable left side portion.

In such embodiments of the hospital gowns that have pronounced sleeve portions, the front panel can be releasably securable to the back panel at different locations by a plurality of fastener devices disposed on the interior surfaces of the front and back panels to form the releasable right shoulder portion, the releasable left shoulder portion, the releasable right bottom arm portion, the releasable left bottom arm portion, the releasable right side portion and the releasable left side portion. The fastener devices that form the releasable right bottom arm portion and the releasable right side portion for each front and back panel can be integral with each other and the fastener devices that form the releasable left bottom arm portion and the releasable left side portion for each front and back panel can also be integral with each other. Alternatively, the fastener devices that form the releasable right bottom arm portion and the releasable right side portion for each front and back panel can be separate from each other and the fastener devices that form the releasable left bottom arm portion and the releasable left side portion for each front and back panel can be separate from each other.

In some embodiments, a hospital gown can comprise a front panel comprising an exterior surface and an opposite interior surface. The front panel can further comprise a head end, a bottom end, a left side and a right side. The hospital gown can also comprise a back panel comprising an exterior surface and an opposite interior surface. The back panel can further comprise a head end, a bottom end, a left side and a right side. The hospital gown can also comprise right shoulder fastener device comprising a front panel right shoulder fastener member attached to the right side of the head end of the interior surface of the front panel and a corresponding back panel right shoulder fastener member attached to the right side head end of the interior surface of the back panel. The front panel right shoulder fastener member can be releasably securable to the corresponding back panel right shoulder fastener member to permit detachment and reattachment. The hospital gown can further comprise a left shoulder fastener comprising a front panel left shoulder fastener member attached to the left side of the head end of the interior surface of the front panel and a corresponding back panel left shoulder fastener member attached to the left side head end of the interior surface of the back panel. The front panel left shoulder fastener member can be releasably securable to the corresponding back panel left shoulder fastener member to permit detachment and reattachment.

In such embodiments, the hospital gown can additionally comprise a right side fastener comprising a front panel right side fastener member attached to the right side of the interior surface of the front panel and a corresponding back panel right side fastener member attached to the right side of the interior surface of the back panel. The front panel right side fastener member can be releasably securable to the back panel left side fastener member to permit detachment and reattachment. Similarly, the hospital gown can comprise a left side fastener comprising a front panel right side fastener member attached to the left side of the interior surface of the front panel and a corresponding back panel left side fastener member attached to the left side of the interior surface of the back panel The front panel left side fastener member can be releasably securable to the back panel left side fastener member to permit detachment and reattachment.

Further, in such embodiments, the left and right shoulder fasteners can be spaced apart from one another at the head end to form a neck opening. Additionally, the right shoulder fastener and the right side fastener can be spaced apart from one another at the head end to form a right arm opening, while the left shoulder fastener and the left side fastener can be spaced apart from one another at the head end to form a left arm opening.

For such embodiments of the hospital gown, the right shoulder fastener, left shoulder fastener, right side fastener, and left side fastener can each comprise a plurality of individual fasteners. In some embodiments, the fastener devices can each comprise a plurality of individual fasteners. In some embodiments, the individual fasteners of the plurality of individual fasteners can be snap fasteners. In some embodiments, the individual fasteners of the plurality of individual fasteners can be mating male/female fasteners. In some embodiments, the individual fasteners of the plurality of individual fasteners can be hook and loop fasteners. In some embodiments, the fastener devices each can comprise a hook and loop fastener.

A method of making a hospital gown can also be provided. The method can comprise providing a front panel comprising an exterior surface and an opposite interior surface and a back panel comprising an exterior surface and an opposite interior surface. The front panel can then be releasably secured to the back panel at different locations to create a gown with the interior surface of the front panel facing the interior surface of the back panel and to form a releasable right shoulder portion, a releasable left shoulder portion, a releasable right side portion and a releasable left side portion of the gown in manner that permits detachment and reattachment of the front and back panels.

In some such embodiments of the method, the interior surface of the front panel and the interior surface of the back panel can comprise a plurality of fastener devices disposed on the interior surfaces of the front and back panels. Such methods can further comprise attaching and detaching the plurality of portions of the fastener devices disposed on the interior surface of the front panel to the plurality of portions of the fastener devices disposed on the interior surface of the back panel to form and release the releasable right shoulder portion, the releasable left shoulder portion, the releasable right side portion and the releasable left side portion as needed.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A hospital gown comprising;

a front panel comprising an exterior surface and an opposite interior surface;

a back comprising an exterior surface and an opposite interior surface; and the front panel releasably securable to the back panel at different locations to create a gown with the interior surface of the front panel facing the interior surface of the back panel and to form a releasable right shoulder portion, a releasable left shoulder portion, a releasable right side portion and a releasable left side portion of the gown;

a neck opening being formed between the sable right shoulder portion and the releasable left shoulder portion, a right arm opening being formed between the releasable right shoulder portion and the releasable right side portion and a left arm opening being formed between the releasable left shoulder portion and the releasable left side portion;

the front panel being releasebly securable to permit detachment and reattachment to the back panel at different locations by a plurality of fastener devices disposed on the interior surfaces of the front and back panels to form the releasable right shoulder portion, the releasable left shoulder portion, the releasable right side portion and the releasable left side portion; and fastener devices that form the releasable right side portion are positioned along an axis that bisects the releasable right shoulder portion and is at a distance farther inward from respective right side edges of the front than the releasable right shoulder portion to provide free sections of the front and back panel with no fastener devices in the free sections of the front panel and the back panel on the right side edges to permit gripping the exterior surface on the free sections of either the front panel or the back panel to release the right side fastener devices while the fastener devices that form the releasable left side portion are positioned along an axis that bisects the releasable left shoulder portion and is at a distance farther inward from respective left side edges of the front and back panels than the releasable left shoulder portion to provide free sections of the front and back panel with no fastener devices in the free sections of the front panel and the back panel on the left side edge to permit gripping the exterior surface the free sections of either the front panel or the back panel to release the left side fastener devices.

2. The hospital gown according to claim 1, wherein the fastener devices each comprises a plurality of individual fasteners.

3. The hospital gown according to claim 2, wherein the individual fasteners of the plurality of individual fasteners comprise at least one selected from the group consisting of snap fasteners, mating male/female fasteners, or hook and loop fasteners.

4. The hospital gown according to claim 1, wherein the fastener devices each comprises a hook and loop fastener.

5. A hospital gown comprising:

a front panel comprising an exterior surface end an opposite interior surface, the front panel further comprising a head end, bottom end, a left side and a right side;

a back panel comprising an exterior surface and opposite interior surface, the back panel further comprising a head end bottom end, a left side and a right side;

a right shoulder fastener device comprising a front panel right shoulder fastener member attached to the right side of the head end of the interior surface of the front panel and corresponding back panel right shoulder fastener member attached to the right side head end of the interior of the back panel, the front panel right shoulder fastener member being releasably securable to the corresponding back panel right shoulder fastener member;

a left shoulder fastener device comprising a front panel left shoulder fastener member attached to the left side of the head end of the interior surface of the front panel and a corresponding back panel left shoulder fastener member attached to the left side head end of the interior surface of the back panel, the front panel left shoulder fastener member being releasebly securable to the corresponding back panel left shoulder fastener member;

a right side fastener device comprising a front panel right side fastener member attached to the right side of the interior surface of the front panel and a corresponding back panel right side fastener member attached to the right side of the interior surface of the back panel, the front panel right side fastener member being releasably securable to the back panel left side fastener member;

a left side fastener device comprising a front panel right side fastener member attached to the left side of the interior surface of the front panel and a corresponding back panel left side fastener member attached to the left side of the interior surface of the back panel, the front panel left side fastener member being releasably securable to the back panel left side fastener member;

wherein the left and right shoulder fastener devices are spaced apart from one another at the head end to form a neck opening, the right shoulder fastener device and the right side fastener device are spaced apart from one another at the head end to form a right arm opening, and the left shoulder fastener and the left side fastener are spaced apart from one another at the head end to form a left arm opening□ wherein the front and back right side fastener members are positioned at a distance that s farther inward from respective right side edges of the respective front and back panels than the respective front and back right shoulder fastener members to provide free sections of the front and back panel with no fastener devices in the free sections of the front panel and the back panel on the right side edges to permit gripping the exterior surface on the free sections of either the front panel of the back panel to release the right side fastener members and the front and back right side fastener members are positioned along an axis that bisects the respective front and back right shoulder fastener members; and wherein the front and back left side fastener members are positioned at a distance that l farther inward from respective left side edges of the respective front and back panels than the respective front and back left shoulder fastener members to provide free sections of the front and back panel with no fastener devices in the free sections of the front panel and the back panel on the left side edges to permit gripping the exterior on the free sections of either the front panel or the back panel to release the left side fastener members and the front and back left side fastener members are positioned along an axis that bisect the respective front and back left shoulder fastener members.

6. The hospital gown according to claim 5, wherein the right shoulder fastener, left shoulder fastener, right side fastener, and left side fastener each comprises a plurality of individual fasteners.

7. The hospital gown according to claim 6, wherein the individual fasteners of the plurality of individual fasteners comprise at least one select d from the group consisting of snap fasteners, mating male/female fasteners, or hook and loop fasteners.

8. The hospital gown according to claim 5, wherein the right shoulder fastener device, left shoulder fastener device, right side fastener device, and left side fastener device each comprises a hook and loop fastener.

* * * * *